US005227045A

United States Patent [19]

Townsend

[11] Patent Number: 5,227,045

[45] **Date of Patent: * Jul. 13, 1993**

[54] SUPERSATURATION COATING OF CATHODE SUBSTRATE

[76] Inventor: Douglas W. Townsend, 492 Longtowne Ct., Glen Burnie, Md. 21061

[ * ] Notice: The portion of the term of this patent subsequent to Jul. 2, 2008 has been disclaimed.

[21] Appl. No.: 814,596

[22] Filed: Dec. 30, 1991

Related U.S. Application Data

[63] Continuation of Ser. No. 697,992, May 15, 1991, Pat. No. 5,158,655, which is a continuation-in-part of Ser. No. 294,781, Jan. 9, 1989, Pat. No. 5,028,301.

[51] Int. Cl.[5] ..... C25D 9/04; C25C 3/06

[52] U.S. Cl. ..... 205/230; 204/67

[58] Field of Search ..... 204/67; 205/230–233

[56] References Cited

U.S. PATENT DOCUMENTS

| | | | |
|---|---|---|---|
| 400,766 | 4/1889 | Hall | 204/243 R |
| 3,028,324 | 4/1962 | Ransley | 204/67 |
| 3,067,124 | 12/1962 | De Pava | 204/244 |
| 3,400,061 | 9/1968 | Lewis et al. | 204/67 |
| 3,471,380 | 10/1969 | Bullough | 204/67 |
| 3,785,807 | 1/1974 | Backerud | 420/552 |
| 3,961,995 | 6/1976 | Alliot et al. | 420/552 X |
| 4,093,524 | 6/1978 | Payne | 204/67 X |
| 4,333,813 | 6/1982 | Kaplan et al. | 204/243 R |
| 4,341,611 | 7/1982 | Kaplan | 204/243 R |
| 4,383,970 | 5/1983 | Komuro et al. | 420/552 X |
| 4,466,692 | 8/1984 | Sonoda | 439/730 |
| 4,466,995 | 8/1984 | Boxall et al. | 204/290 R X |
| 4,466,996 | 8/1984 | Boxall et al. | 204/67 X |
| 4,526,911 | 7/1985 | Boxall et al. | 523/445 |
| 4,544,469 | 10/1985 | Boxall et al. | 204/243 R |
| 4,560,448 | 12/1985 | Sane et al. | 204/67 |
| 4,624,705 | 11/1986 | Jatkar et al. | 420/552 X |
| 4,624,766 | 11/1986 | Boxall et al. | 204/294 |
| 5,028,301 | 7/1991 | Townsend | 205/230 |
| 5,135,621 | 8/1992 | de Nora et al. | 204/67 |

FOREIGN PATENT DOCUMENTS

| | | | |
|---|---|---|---|
| 0021850 | 1/1980 | European Pat. Off. . | |
| 1268812 | 3/1972 | United Kingdom | 420/552 |

*Primary Examiner*—Donald R. Valentine
*Attorney, Agent, or Firm*—Morton J. Rosenberg; David I. Klein

[57] ABSTRACT

This invention relates to a process of electrowinning molten aluminum from alumina dissolved in molten fluoride salts which is essentially cryolite. More specifically the process relates to the treatment of aluminum reduction cell drained solid cathode surfaces to protect them while they are wetted by molten aluminum metal. This process produces aluminum wetted protective coatings composed of titanium diboride and titanium carbide and other refractory metal borides and carbides on top of a carbon-titanium diboride materials layer on the cathode surfaces from supersaturated dissolved elements in electrowon aluminum. The resulting protective coating is resistant to erosion, chemical attack, and penetration by molten aluminum metal, sodium, and cryolite electrolyte contained in that cell.

47 Claims, 5 Drawing Sheets

SUPERSATURATION COATING OF CATHODE SUBSTRATE

This is a continuation in part of application Ser. No. 07/697,992, filed on May 15, 1991, now U.S. Pat. No. 5,158,655 which was a continuation in part of Ser. No. 07/294,781, filed on Jan. 9, 1989, now U.S. Pat. No. 5,028,301.

BACKGROUND OF THE INVENTION

The field of the invention is chemical and electrical processes for synthesizing metal from a fused bath and the present process is particularly concerned with electrowinning aluminum from a fused bath of cryolite and aluminum compounds.

The state of the art of the electrowinning process begins with U.S. Pat. No. 400,766 and the state of the art of the aluminum reduction cell useful in the present invention may be understood by reference to U.S. Pat. No. 3,400,061 and 4,093,524, the disclosures of which are incorporated herein by reference. Also incorporated by reference herein are U.S. Pat. Nos. 3,028,324; 3,067,124; 3,471,380; 4,333,813; 4,341,611; 4,466,995; 4,466,996; 4,526,911; 4,544,469; 4,560,448; 4,624,766 and European Patent Application 0 021 850 which show the state of the art of protecting cathodes from erosion while electrowinning aluminum.

U.S. Pat. Nos. 3,028,324, 3,471,380 and 4,560,448 disclose particular solutions of titanium in molten aluminum.

Most aluminum metal is smelted by being electrowon from alumina, $Al_2O_3$, dissolved in a molten salt electrolyte which is mostly cryolite, $Na_3AlF_6$, by a process little changed from that described by Hall (U.S. Pat. No. 400,766, 1889). The cryolite electrolyte usually also contains several percentage of each of aluminum fluoride, $AlF_3$, and calcium fluoride, $CaF_2$. The cryolite electrolyte may also contain several percentage of both magnesium fluoride, $MgF_2$, and lithium fluoride, LiF. The electrolyte fills most of the bottom part of the cavity of the cell including the vertical gap between the cathode and anodes. The electrowinning smelting process is carried out at temperatures that may be as low as 920° C. and/or as high as 1000° C. The usual operating temperature range is from 950° C. to 975° C. Conventional aluminum smelting cells are well described in THE ENCYCLOPEDIA OF ELECTROCHEMISTRY, Reinhold Publishing Corporation, New York, 1964. These conventional cells are constructed with carbon anodes and in modern cells carbon block cathodes, called in the industry "cathode blocks". The carbon blocks hold a cathode pool, often called the cathode pad in the industry, containing up to 12 tons of molten aluminum metal that serves electrochemically as the actual cathode. The whole structure, including the carbon cathode blocks, steel electrical current conductors, insulation, and steel pot shell is known in the industry as the "cathode." The anode is geometrically above the cathode by virtue of the fact that cryolite is slightly lighter than aluminum. It floats on top of the molten aluminum metal and washes around the carbon anodes. The anodes are chemically attacked in the electrowinning smelting process and must be replaced about every two weeks. Cathodes must last the expected 3 to 10 year life of the cell.

The pool of molten aluminum is called the cathode or metal pad. In conventional aluminum reduction cells, the metal cathode pool ranges in depth from 5 to 30 centimeters to produce enough hydrostatic pressure to force the molten metal pool into electrical contact with the carbon cathode blocks. This is necessary because molten aluminum poorly wets the surface of the carbon cathode substrate. Electrical contacts are made with areas of the carbon surface that are momentarily free of electrically insulating materials. At any given moment there are only relatively small areas of good electrical contact between the aluminum pool and the cathode blocks. The remainder of the interface is insulated by a thin layer of molten cryolite, deposits of undissolved alumina ore, and by aluminum carbide, which is a poor electrical conductor. Aluminum carbide readily forms by chemical reaction between molten aluminum metal and carbon of the cathode blocks wherever the two are in contact. Aluminum carbide is somewhat soluble in cryolite electrolyte. It is dissolved away by a layer of cryolite electrolyte that is normally found between most areas of the metal pool and the carbon cathode despite the hydrostatic pressure exerted by the pool of molten aluminum. Cryolite, not aluminum, prefers to wet carbon and aluminum carbide surfaces. All areas of the cathode block carbon surface are periodically eaten away by the process of reacting with aluminum metal to form aluminum carbide which is dissolved away by a layer of molten cryolite. Cryolite is continuously dragged between the aluminum pool and the carbon cathode by motion of the aluminum pool. Wherever aluminum carbide is dissolved away, the carbon cathode blocks may again come into electrical contact with molten metal and for a brief time conduct electricity away from the metal pool. The carbon surface of the cathode is thus steadily eroded away at rates that are typically 1 to 5 centimeters per year.

The top surface of the molten aluminum metal cathode pool is covered by standing and moving waves. The tops of the metal waves tend to short circuit the aluminum electrowinning process by making electrical short circuit paths between the anodes and the cathode. Such shorting results in losses of 6% to 20% in current efficiency in the smelting industry. Most existing smelters have current efficiencies that range from 78% to 90% out of the possible 98% that can be theoretically obtained. The current efficiency is measured by the total amount of metal actually collected from the cell divided by the amount that could have been collected if one aluminum atom were produced for every three electrons that flow through the cell.

Electrical short Circuiting in aluminum reduction cells with metal cathode pools is reduced by increasing the vertical distance between the anode and the cathode to about 5 centimeters. Cryolite based electrolyte in the gap between the cathode and anodes has an electrical resistivity of about 0.42 ohm-cm and carries a direct electrical current of between 0.7 and 1.5 Amperes/$cm^2$. The electrical current flowing through the cryolite electrolyte in the gap between the anode and the cathode generates electrical heat, and wastes large amounts of electrical power. Reduction of the vertical gap between the cathodes and anodes to 1 to 2 centimeters can save from 2 to 4 kilo Watt hours per kilogram, of aluminum electrovon. This is up to 25% of the power normally required to smelt aluminum. An additional benefit from a drained cathode cell is an increase in cell current efficiency of from 5% to 20%.

The height of the waves on the aluminum pool has been reduced in some of the more recently constructed smelters by computer aided design of the array of electrical conductors that together generate complex patterns of magnetic vectors in the aluminum pool. These magnetic vectors interact with the electrical current flowing in the aluminum pool to cause high metal velocities in the aluminum pool and to generate waves on its surface. Some waves run from side to side, others from end to end while others rotate around the perimeter of the pot. It is most difficult and expensive to reduce the intensities of the various components of the magnetic field in existing smelters to reduce metal motion.

One possible way to prevent the molten aluminum from forming waves is to remove the metal pool from the cathode surface and to smelt aluminum on a raised solid cathode surface. An example of this design of aluminum smelting cell is illustrated by Lewis et al (U.S. Pat. No. 3,400,061). The raised cathode surface must be covered by a coating that is wetted by the molten aluminum. The coating must not be significantly attacked by either the molten cryolite or molten aluminum during operation of the cell. The coating must last from three to five years to give the cell an economically long life.

The desire to reduce the electrical power consumption in the smelting of aluminum has resulted in many conceptual designs for aluminum reduction cells and the construction of a few prototype production cells having solid cathode surfaces drained of aluminum metal. For such a cell to smelt alumina efficiently, aluminum metal must easily wet raised solid cathode surfaces so that the electrowon aluminum metal sticks to the cathode surface and drains off into collection wells away from the areas of electrolysis without being carried off into the cryolite electrolyte as tiny droplets.

Titanium diboride has been identified as a material ideally suited to form the solid cathode surface, Ransley (U.S. Pat. No. 3,028,324, 1962). Whenever titanium diboride is mentioned in this application, it must be understood that the borides of Groups IV-B, V-B and VI-B of the periodic table which include the elements; titanium, zirconium, hafnium, chromium, vanadium, niobium, tantalum, chromium, molybdenum, and tungsten and mixtures thereof may be substituted for titanium diboride. Titanium diboride and similar diborides are wetted by aluminum metal, are excellent electrical and thermal conductors and are sparingly soluble in both molten aluminum metal and cryolite based electrolytes.

Some prior United States Patents have attempted to provide this aluminum wetted surface by covering the structural carbon blocks of the cathode with tiles made from titanium and zirconium diborides; Lewis et al (U.S. Pat. No. 3,400,061), Payne (U.S. Pat. No. 4,093,524) and Kaplan (U.S. Pat. No. 4,333,813 and U.S. Pat. No. 4,341,611). Many attempts have been made to coat carbon cathode surfaces of drained cathode aluminum reduction cells with smeared coatings composed of titanium diboride mixed with carbon cement; Boxall et al (U.S. Pat. No. 4,544,469; 4,466,692; 4,466,995; 4,466,996; 4,526,911; 4,544,469 and 4,624,766). Attempts have also been made to form titanium diboride coatings on the surface of the carbon cathode substrate by electroplating prior to producing aluminum metal; Biddulph et al (European Patent Application 0 021 850).

Cathode coatings and structures made according to the various arts found in all previous patents have not yet been successful in providing an aluminum wetted cathode surface that is resistant to both molten aluminum metal and cryolite electrolyte. The aluminum wetted structures produced by each art suffers from at least one of the following failure mechanisms: the coating material is attacked by aluminum metal or cryolite electrolyte; preformed structural shapes are easily cracked and broken by rough handling or by stresses caused by uneven thermal expansion during cell start-up; a difference in the coefficient of thermal expansion between the coating and carbon cathode substrate combined with attaching the coating material at room temperature, with a glue that becomes brittle at a temperature well below the cell operating temperature, causes shear stresses that results in disbondment of the tiles; or the glue is chemically attacked and dissolved by cryolite electrolyte and/or aluminum metal and sodium.

Most patented cathode coating systems for aluminum smelting are based on preformed structures containing titanium diboride which are glued or screwed to the cathode blocks and to the rammed or glued joints between the blocks. Preformed structures may be pure titanium diboride or mixtures of titanium diboride and bonding materials such as carbon and aluminum nitride. Refractory materials structures containing titanium diboride are expensive to fabricate and install in the cell. The glues used are usually various formulations of carbon cement that are bonded together by amorphous carbon. Large shear stresses may develop between titanium diboride preformed structures and the carbon cathode block because both semi-graphitic and graphitic forms of carbon cathode blocks have a lower coefficient of thermal expansion than has titanium diboride. Shear stresses that develop while the cell is heating up to its normal 970° C. operating temperature can cause the glue joint to crack and titanium diboride structures to disbond from the cathode blocks, even before the cell starts to operate. Breakage of titanium diboride structures may occur because of stresses that result from differential thermal expansion during cell heat up. Cells thus constructed can be heated only by slow and careful procedures that properly cure and bake carbon cement and prevent these preformed structures that contain titanium diboride from being mechanically damaged by cracking or spalling.

Special care is required to prevent air burn damage to carbon cement and titanium diboride during the cell heat up step. Typical means of heating cells for start up are to use oil or gas burners to preheat the cathode surface over a period of 8 to 24 hours to a temperature of about 800° C., while the cathode surface is protected by inert or chemically reducing materials that exclude air. When the cell reaches a temperature of about 800° C., molten cryolite is usually poured into the cell and the process of electrowinning aluminum started. Electrical resistance heating associated with electrowinning aluminum is used to further heat the cell to the equilibrium operating balance between electrical heat generated, process heat used and thermal losses.

Any carbon cement glue joint holding structures containing titanium diboride to the carbon cathode substrate that survives cell start up is usually rapidly attacked during cell operation by cryolite, sodium and aluminum, just as the carbon cathode blocks of a conventional aluminum smelting cell are attacked. Aluminum metal tries to wet the titanium diboride side of the glue joint, while cryolite tries to wet the carbon side of the glue joint and dissolve the aluminum carbide formed from the carbon cement.

Carbon cathode blocks Which form the cathode substrate normally undergo from 0.2% to 2% expansion in volume during the first 60 days of cell operation as electroreduced sodium and lithium metals intercalate with the carbon. Any attached structure or cathode coating containing titanium diboride must either swell at the same rate as the carbon blocks or else be able to withstand the stresses caused by cathode block expansion.

Structural shapes containing titanium diboride and carbon that are sintered at temperatures above about 1500° C. are too hard and brittle to be successfully glued to cathode blocks. They either disbond from the cathode blocks while the glue bakes or are too brittle to withstand the incurred stresses which develop during cell start up and normal operation.

Another approach to making an aluminum wetted cathode surface is to mix either coarse chunks or finely divided titanium diboride with carbon cement containing non-graphitic carbon or pitch to form composite materials containing carbon and titanium diboride. These refractory materials having a carbon matrix which binds together dispersed titanium diboride particles are hereby designated carbon-titanium diboride materials. The process and materials for manufacturing structures and coatings of composite materials containing carbon and titanium diboride may be found in U.S. Pat. No. 4,582,555 to Buchta and U.S. Pat. Nos. 4,544,469; 4,466,692; 4,466,995; 4,466,996; 4,526,911; 4,544,469 and 4,624,766 to Boxall et al. If these materials contain over about 20% by volume titanium diboride, they may be wetted on a macroscopic scale by aluminum metal that bridges over the carbon and aluminum carbide between particles of aluminum wetted titanium diboride. Any carbon and aluminum carbide at the surface of the carbon-titanium diboride materials surface is wetted by cryolite. Except for being slowly dissolved by aluminum metal, titanium diboride is essentially chemically inert.

Titanium diboride powder mixed with carbon cement may be smeared onto the cathode block surface in a layer up to about 4 centimeters thick when building the cell cathode. This material may be cured and then baked into a carbon-titanium diboride material as the cell is heated during start-up. Alternatively titanium diboride powder, mixed with carbon cement may be formed into molds and baked into carbon-titanium diboride material structural shapes at temperatures below 1500° C. and then glued to the carbon cathode substrate. Preformed structures containing titanium diboride and carbon which are sintered above 1500° C. are difficult to glue to the cathode blocks. Carbon-titanium diboride materials are generally softer but tougher than carbon-titanium diboride preformed structures sintered above 1500° C.. Carbon-titanium diboride materials that are not heated to over 1200° C. generally adhere to the cathode blocks during cell start up. Carbon-titanium diboride materials structures and coatings however tend to fail rapidly during cell use because cryolite, sodium, and lithium readily penetrate this type of material and react with the non-graphitic carbon matrix to form aluminum carbide. Amorphous carbon contained in carbon cements react more readily with intercalated sodium and lithium and cryolite to form aluminum carbide than does more graphitic forms of carbon.

If aluminum is smelted directly on a carbon-titanium diboride material surface, aluminum carbide forms first on the top surface and along cracks. Considerable mechanical expansion occurs during the formation of aluminum carbide since this material occupies about four times the volume of the carbon required to form it. As aluminum carbide forms along cracks and is dissolved by the cryolite, the coating rapidly disintegrates. Carbon-titanium diboride materials have little resistance to erosion by molten cryolite based electrolytes and are also rapidly oxidized by carbon dioxide bubbles that may be periodically swept against its surface. Carbon-titanium diboride materials may crack and spall due to freeze-thaw damage if cold anodes are placed too close to the cathode and the cryolite freezes onto the cathode surface. Both carbon dioxide attack and freeze-thaw damage is more likely when an anode is inadvertently set lower into the cathode cavity than is intended. If used as a cathode surface in a drained cathode cell, carbon-titanium diboride material layers are typically lost at a rate of about a centimeter per month.

No carbon-titanium diboride materials smeared surface layer, or preformed carbon-titanium diboride materials structure which has been glued onto the cathode blocks, can be mechanically repaired or replaced without shutting the cell down. For an aluminum wetted cathode surface to endure, it must be able to withstand mechanical abuse that is normal to cell operation, including being poked by steel bars and other tools used to work the cell and make measurements, anodes dropping on it, alumina ore deposits that may from time to time fall onto and even freeze to it, cryolite electrolyte freezing, occasional burning by carbon dioxide bubbles, electric arcing caused by short circuits to the anode as well as erosion by strong turbulence in the cryolite electrolyte. A drained cathode aluminum reduction cell does not operate economically and overheats if it looses more than about 15% of its aluminum wetted cathode surface area.

SUMMARY OF THE INVENTION

The present invention relates to novel processes for protecting carbon-titanium diboride materials surface layers on the carbon block cathode substrate in drained cathode aluminum reduction cells from deterioration by coating them, after the cell has begun to smelt aluminum, with an aluminum metal wetted coating that is resistant to attack from aluminum metal and cryolite.

According to the present invention, there is provided a method of coating a carbon-titanium diboride materials layer on carbon cathode blocks used to construct a raised cathode surface in a raised cathode type reduction cell during the production of aluminum and/or of maintaining an aluminum wetted coating on a drained cathode surface on top of the carbon-titanium diboride materials layer of an aluminum reduction cell while aluminum is being smelted from a solution of aluminum oxide dissolved in molten cryolite. The method(s) of the present invention comprises the steps of:

Feeding oxides and salts into molten cryolite electrolyte within said cell containing a carbon-titanium diboride materials layer on top of the cathode blocks and creating concentrations of ions containing aluminum and oxygen, ions containing a metallic element selected from the group consisting of titanium, zirconium, hafnium, chromium, vanadium, niobium, tantalum, molybdenum, tungsten and mixtures thereof, and ions containing boron in said molten cryolite electrolyte;

electrowinning from said molten cryolite electrolyte a molten aluminum metal film against said raised cathode surface, said film containing dissolved concentrations of said metallic element or mixtures thereof and boron, which together supersaturate said aluminum metal film with the boride or mixture of borides of said metallic elements;

passing said molten aluminum metal film across said raised surface of said cathode, said raised surface having a carbon-titanium diboride materials layer that is wetted by molten aluminum metal; and depositing on said raised surface comprising a carbon-titanium diboride materials layer, a protective boride coating created from concentrations of said metallic element or mixtures of said metallic elements and boron that exceed the saturation concentration of said boride or mixture of said borides in said molten aluminum film.

The invention also extends to a method of operating a raised cathode type aluminum reduction cell in which the aforementioned steps are proceeded by heating the cell to operating temperature, and in one embodiment said operating method comprises the steps of:

Heating the cell to operating temperature;

feeding said cell with a solution of dissolved aluminum oxide, dissolved ions containing a metallic element selected from the group consisting of titanium, zirconium, hafnium, chromium, vanadium, niobium, tantalum, molybdenum, tungsten and mixtures thereof, and dissolved ions containing boron, in said molten cryolite electrolyte;

electrowinning from said molten cryolite electrolyte, a molten aluminum metal film against said raised carbon-titanium diboride materials layer and the titanium diboride coating on top of the carbon-titanium diboride materials layer, said molten aluminum film containing concentrations of said dissolved metallic element or mixtures thereof and boron, which together supersaturate said molten aluminum with the boride or mixture of borides of said metallic elements and react with said carbon cathode substrate to form carbides of titanium, zirconium, hafnium, chromium, vanadium, niobium, tantalum, molybdenum, tungsten and mixtures thereof;

passing said molten aluminum film across said raised cathode surface; and, forming on said carbon-titanium diboride materials layer on the raised cathode surface a thin film of the carbides of said metallic element or mixtures of the carbides thereof and depositing on said raised cathode surface a boride coating created from concentrations of said metallic elements or mixtures of said metallic elements and boron that exceed the saturation concentration of said boride or mixture of said borides in said molten aluminum film.

Advantageously, the method(s) of the invention comprises placing an anode into said molten cryolite, said anode being comprised of carbon and 0.005 to 13% by weight titanium oxide and 0.0015 to 6% by weight boron oxide; and conducting direct electrical current through said anode into said molten cryolite producing carbon dioxide on said anode and dissolving said titanium dioxide and said boron oxide in said molten cryolite electrolyte.

The protective boride coating may have a thickness in the range of 5 angstroms to 5 centimeters and is preferably deposited at a rate of 0.01 to 2.0 centimeters thickness per year. The protective boride may be formed from the borides of a metallic element selected from the group consisting of titanium, zirconium, hafnium, chromium, vanadium, niobium, tantalum, molybdenum, tungsten and mixtures thereof. The preferred protective coating is titanium diboride and for convenience the invention will thereinafter be described by reference to such a boride coating.

In the preferred embodiment, the invention comprises the introduction of small concentrations of oxides and/or salts of titanium and boron into a the cryolite electrolyte to codeposit titanium and boron into the a laminar film of aluminum metal on solid cathode surfaces that includes a layer of carbon-titanium diboride materials and to react with any exposed areas of the carbon-titanium diboride layer, carbon cathode block substrate, and ram or glue joint between cathode blocks to form titanium carbide, and form titanium diboride deposits on the solid part of the cathode. These deposits are wetted by aluminum metal, and protect carbon contained in the cathode from forming aluminum carbide. It is preferable to maintain a relatively small supersaturation of titanium and boron in the laminar film of molten aluminum metal to improve the morphology of the protective coating deposits. Protective diboride deposits may be made more favourably smoother and denser when a relatively low supersaturation of titanium and boron is codeposited than when larger supersaturations are codeposited in the laminar film of aluminum metal. This may be attained by choosing boron and titanium concentrations in the electrodeposited aluminum that produce a titanium diboride plating rate between 0.01 and 2.0 centimeters per year.

Whenever titanium carbide is mentioned in this specification, it is understood that the carbides of Groups IV-B, V-B and VI-B of the periodic table of elements and mixtures thereof are meant as the equivalent of titanium carbide and mixtures thereof and may be substituted for titanium carbide.

BRIEF DESCRIPTION OF THE DRAWINGS

Reference is made by way of example only to the appended drawings that illustrate the chemistry of aluminum, carbon, boron and titanium and a possible design of an aluminum reduction cell employing the method of the present invention. The cell employs sloped solid carbon block cathode substrates having a carbon-titanium diboride materials layer protected by a titanium diboride coating which is wetted by a film of aluminum metal that forms the actual electrochemical cathode surface. The titanium diboride protective coating is formed from co-deposited trace concentrations of titanium and boron that are continuously electrodeposited into the thin molten aluminum laminar cathode film.

DESCRIPTION OF THE PREFERRED EMBODIMENTS

Figure 1:
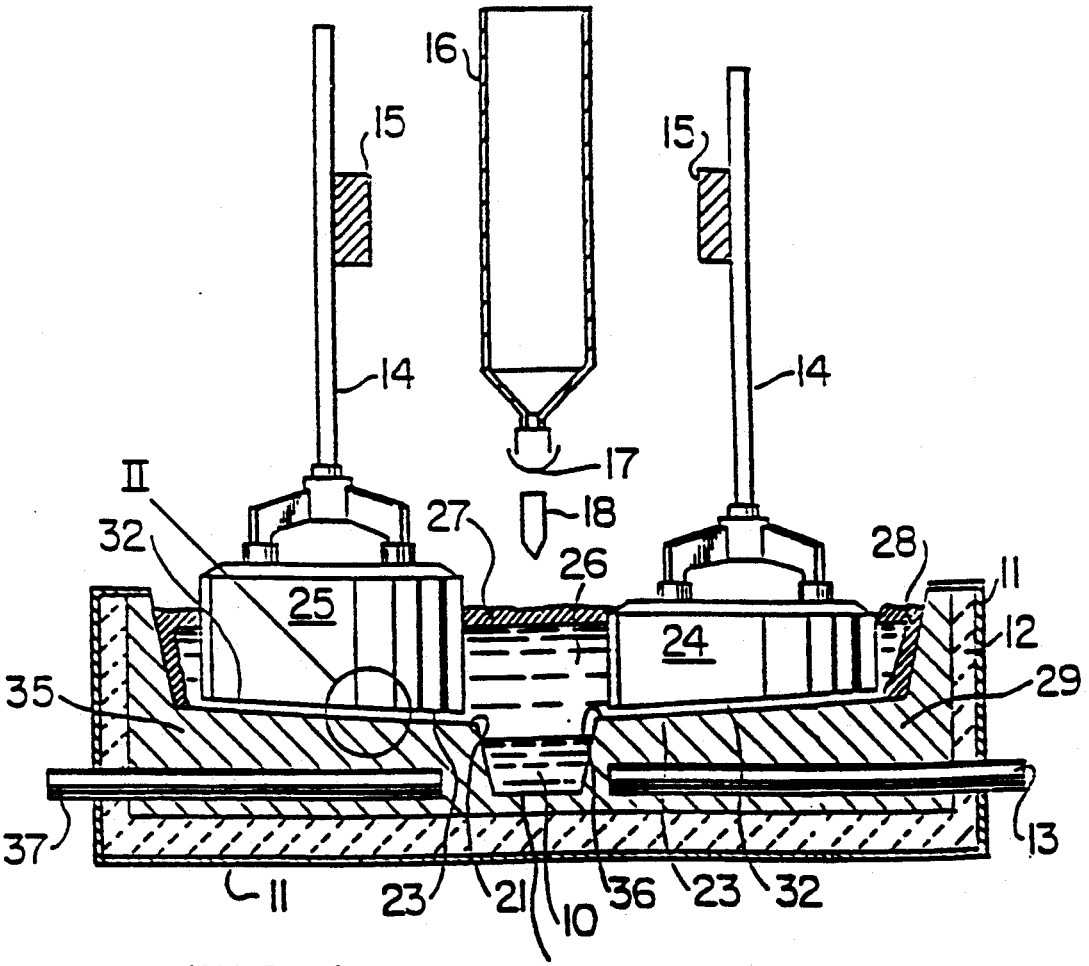
FIG. 1 a vertical section through the aluminum reduction cell.

With particular reference to FIG. 1, the reduction cell comprises a steel shell 11 having a layer of suitable refractory insulation 12 and a cathode substrate comprising prebaked carbonaceous blocks 29 and 35. Steel cathode electrical current collector bars are illustrated as 13 and 37 set into the carbon cathode blocks 29 and 35. Carbonaceous prebaked anodes 24 and 25 are hung into the cell cavity from electrically conductive anode hanger rods 14, which are in electrical contact with anode electrical bus bars 15 from which they are supported. The cell is filled with molten cryolite electrolyte 26 and 32 except for accumulated electrowon aluminum metal 10 held in a well 42 formed between the large cross section of the cathode blocks 29 and 35, a layer of frozen cryolite 27 over the top of the molten cryolite 26 and frozen cryolite layer 28 covering the perimeter of the carbon cell cavity above the level of the cathode surfaces 21 and 36. The bottom surfaces 23 of the carbon anodes 24 and 25 are shaped to correspond to the top surfaces of the cathodes 21 and 36.

Figure 2:
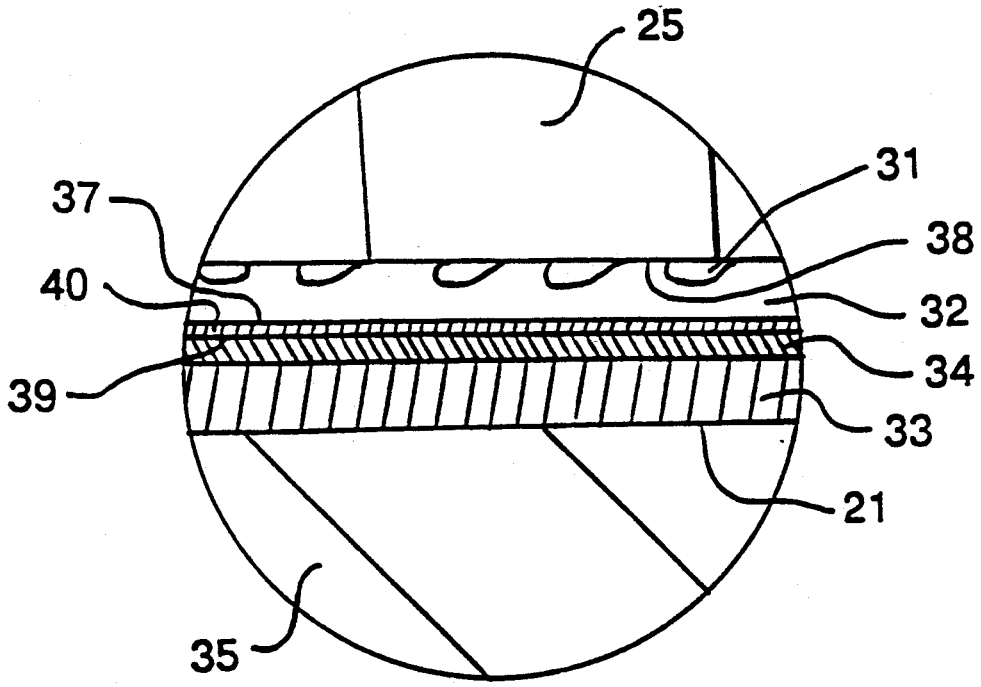
FIG. 2 is a detailed vertical section through a portion of FIG. 1 circled at 2.

FIG. 2 shows the thin laminar film of molten aluminum 40, the titanium diboride protective coating 34, the carbon-titanium diboride materials layer 33 and the carbon cathode block substrate 35 in greater detail. The top surface 21 of the sloped cathode carbon block substrate 35 is covered by a layer of carbon-titanium diboride materials 33 which in turn is covered by a coating of solid protective titanium diboride coating 34, formed from trace concentrations of titanium and boron, deposited by the process of supersaturation plating from the laminar film of molten aluminum 40, that wets the surface 39 of the titanium diboride protective coating 34. Within the vertical distance from the top surface of the laminar film of molten aluminum metal 37 on the cathode to the bottom surface 38 of the anode 25 is a layer of cryolite electrolyte 32 which is urged up the slope by a gas lift pumping action caused by the buoyancy of the carbon dioxide bubbles 31 created by electrolysis of the carbon anode 25. Only the top surface 37 of the aluminum film 40 constitutes that actual electrochical cathode. The solid portions, including the titanium diboride coating 34, the carbon-titanium diboride materials layer 33 and the cathode carbon blocks, 35 are also normally included in the art as part of the cathode.

Figure 3:
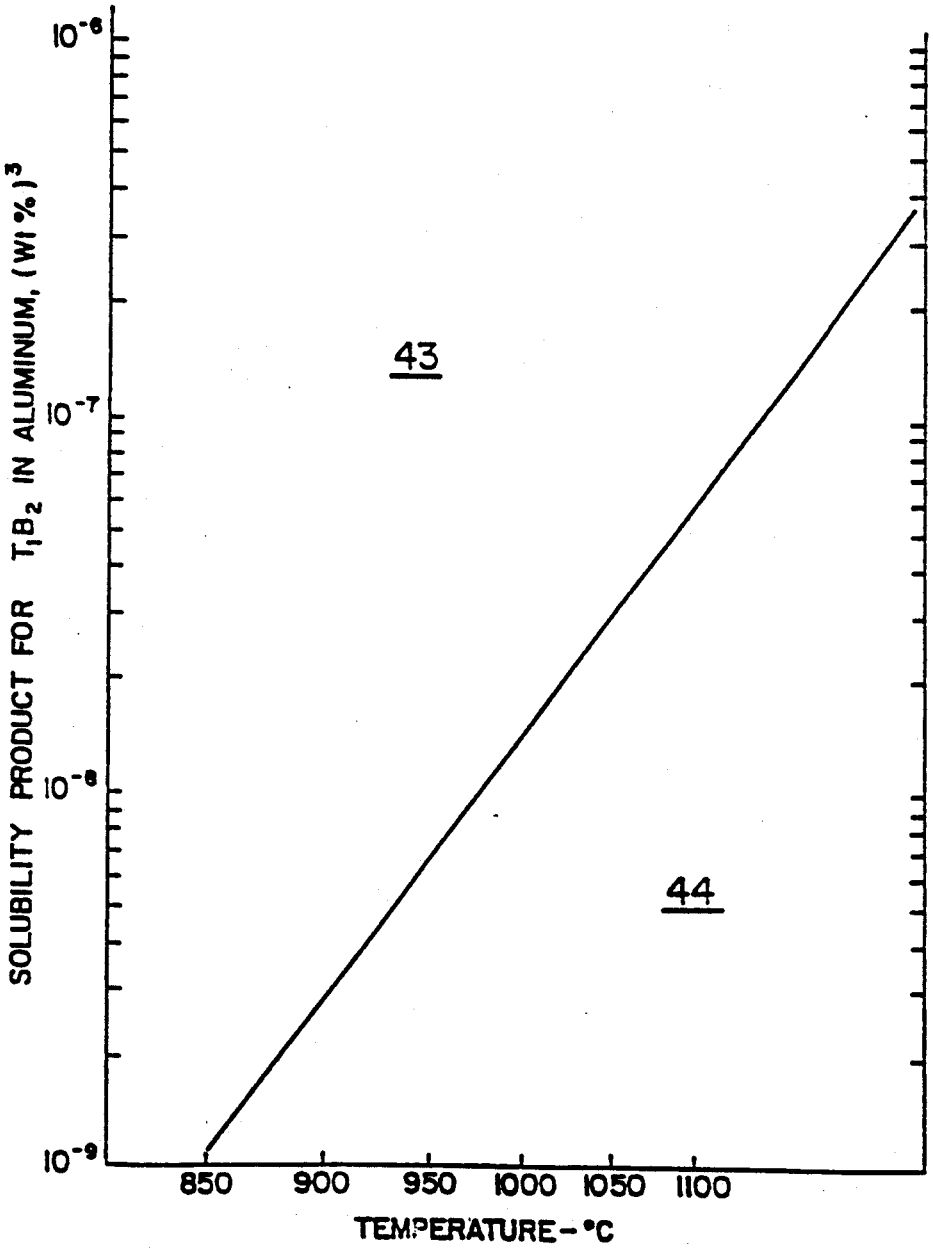
FIG. 3 shows the solubility product of titanium diboride expressed as weight percent titanium times the square of the weight percent boron dissolved in molten aluminum as a function of temperature.

FIG. 3 shows the solubility product of titanium diboride in aluminum metal as a function of temperature as a semilogarithmic plot. Above the sloping line, in area 43, aluminum is supersaturated with titanium and boron and below the sloping line in area 44, aluminum is unsaturated with titanium and boron. Molten aluminum metal which is supersaturated with respect to titanium diboride will deposit titanium diboride on drained cathode surfaces until the titanium diboride concentrations are reduced to satisfy the solubility product.

Figure 4:
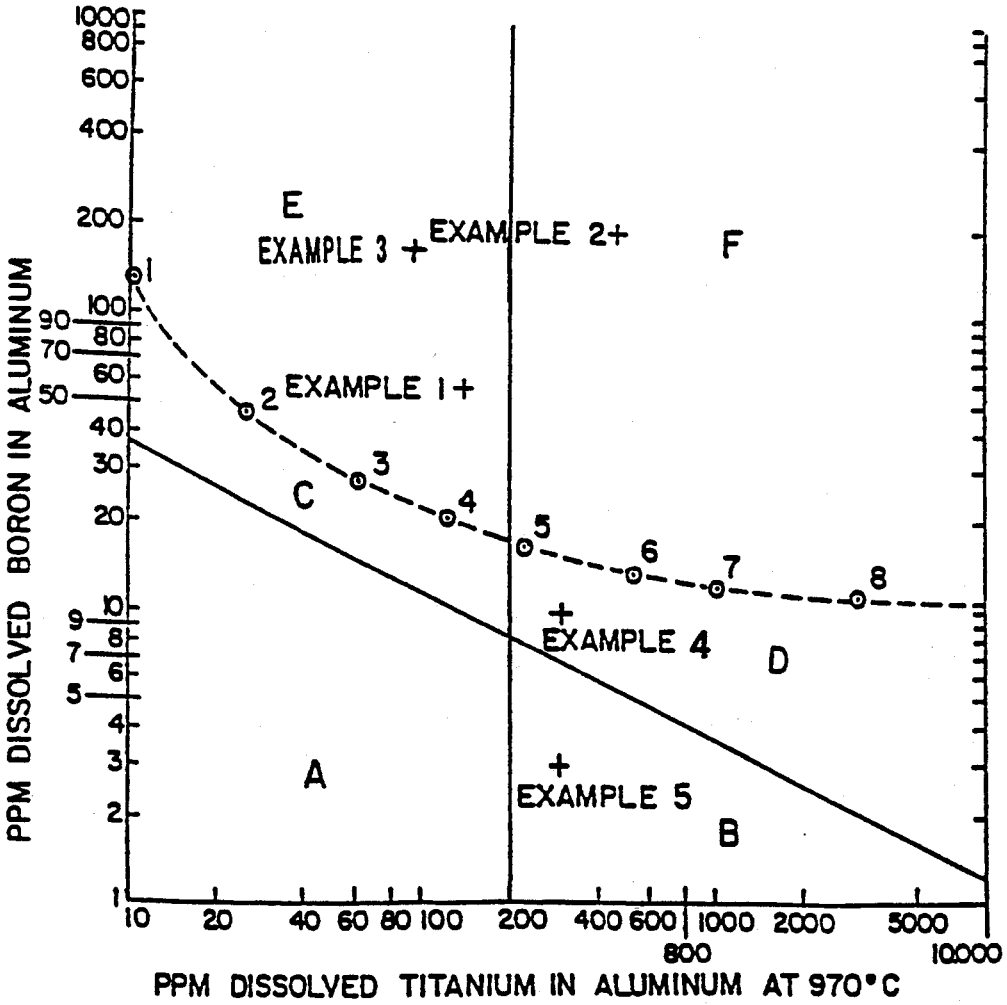
FIG. 4 shows the solubility of titanium diboride in molten aluminum at 970° C. as well as the reactions of titanium with carbon and aluminum carbide.

FIG. 4 shows the logarithmic solubility diagram for titanium, boron, and carbon dissolved in molten aluminum at 970° C. as a function of the concentrations of dissolved boron and titanium over a range from 10 to 1000 parts per million (ppm) boron and from 10 to 5000 ppm titanium. The dashed line is drawn for a cathode current density of 1.0 amperes per square centimeter. The vertical line dividing zones A from B, zones C from D, and zones E from F is drawn at about the stoichiometric solubility product for titanium carbide. The exact division between these zones varies with carbon concentration in the molten aluminum. The stoichiometric titanium carbide solubility in molten aluminum at 970° C. is thought to be 200 ppm titanium and 50 ppm carbon. This carbon concentration is somewhat lower than the carbon concentration in stoichiometric equilibrium with aluminum carbide. At its stoichiometric solubility product, titanium diboride dissolves in aluminum to produce 40 ppm of titanium and 18 ppm of boron. In zone A, at less than about 200 ppm titanium and below the solubility product line for titanium diboride, both titanium diboride and titanium carbide dissolve in molten aluminum. Aluminum reacts with carbon to form aluminum carbide. The carbon-titanium diboride material layer is rapidly attacked. In zone B, at more than about 200 ppm titanium and below the solubility product line for titanium diboride, titanium diboride dissolves in molten aluminum while dissolved titanium chemically reacts with both carbon and aluminum carbide to form solid deposits of titanium carbide. The matrix of the carbon-titanium diboride materials layer which holds titanium diboride particles together must provide the carbon to form titanium carbide. In zone C, at less than about 200 ppm dissolved titanium, above the solubility product line for titanium diboride and below the dashed line, the carbon matrix for the carbon-titanium diboride materials layer may react with aluminum to form disrupting aluminum carbide deposits, and titanium diboride is deposited on the drained cathode surface by the process of supersaturation plating, at a rate less than 0.01 centimeters per year. This titanium diboride deposition rate may be too slow to produce a protective titanium diboride coating. In zone D, above about 200 part per million dissolved titanium and above the solubility product line for titanium diboride but below the dashed line, titanium diboride deposits are formed on the cathode surface by the process of supersaturation plating, but at a rate less than 0.01 centimeters per year while titanium chemically reacts with exposed carbon and aluminum carbide in the carbon-titanium diboride material layer to produce titanium carbide that may be mixed with titanium diboride deposits on the carbon cathode substrate. In zone E, at less than about 200 ppm dissolved titanium and above both the solubility product line for titanium diboride and the dashed line, a titanium diboride coating is deposited on the drained cathode surface by the process of supersaturation plating, at a rate greater than 0.01 centimeters per year. Exposed carbon in the carbon-titanium diboride layer may react with aluminum to form disruptive aluminum carbide. In zone F, above about 200 part per million dissolved titanium and above both the solubility product line for titanium diboride and the dashed line, titanium diboride deposits are formed on the cathode surface by the process of supersaturation plating, at a rate greater than 0.01 centimeters per year, while titanium chemically reacts with carbon and aluminum carbide to produce a titanium carbide coating that may be mixed with titanium diboride deposits on top of the carbon-titanium diboride layer.

Figure 5:
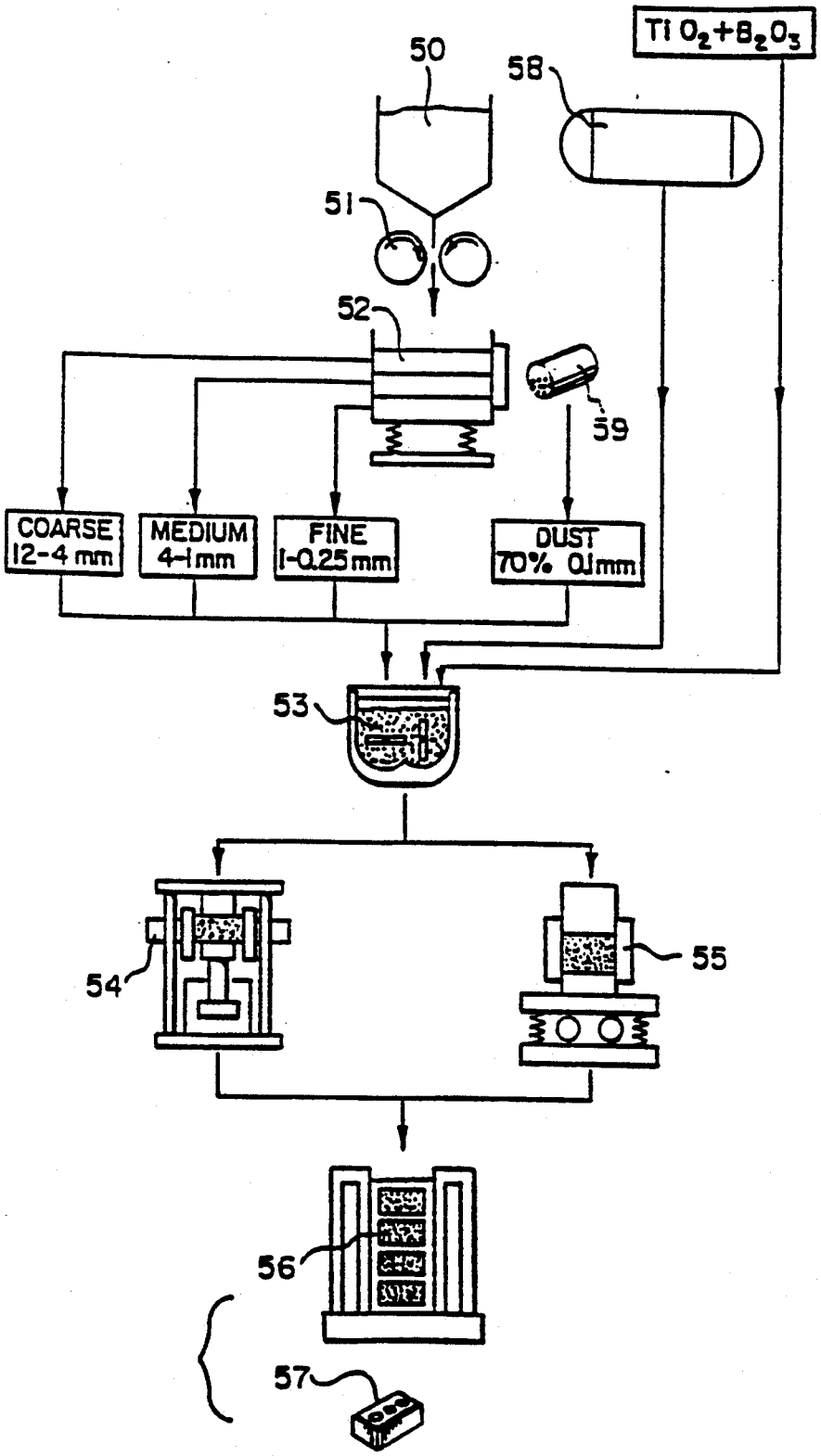
FIG. 5 is an anode production flow sheet showing the production of an anode useful in the present invention.

FIG. 5 shows a schematic anode production flow diagram wherein titanium and boron oxides are mixed with pitch and coke and baked into anode blocks. Fresh coke and anode butts 50 are crushed to below 12 millimeters in size in the crusher 51 and separated into several size fractions by the screen 52. Coke size fractions are mixed with coke dust from the ball mill 59, pitch 58 and $TiO_2+B_2O_3$ in the mixer 53. Anode blocks 57 are formed in either the anode press 54 or vibrating press 55 and then baked in the furnace 56.

The titanium and boron used to form a supersaturated solution with molten aluminum may be supplied by a carbon anode having $TiO_2$ and $B_2O_3$ incorporated therein and prepared according to the flow sheet of FIG. 5. A prebaked carbon anode useful in the present invention and produced by the process of the flow sheet will have 0.005% to 13% by weight $TiO_2$ and 0.0015% to 6%, preferably 0.003% to 5% by weight $B_2O_3$. Anode carbon will generally contain some residual impurities such as sulfur, vanadium, iron, nickel, silicon, and sodium. Meta and ortho boric acids which may be fed to the green anode mix will decompose to $B_2O_3$ during calcining of the anode. Alternatively, titanium carbide and boron carbide can be mixed and baked into the carbon anode and will be fed as ions to the cryolite electrolyte as the face of the anode is burned away by electrolysis.

In improved drained cathode aluminum reduction cells, the bottom surfaces 23 of the anodes 24 and 25 remain nearly parallel to the top surface of the cathodes 29 and 35. Both cathodes and anodes are typically sloped from the horizontal by between 2 and 15 degrees and preferably between 5 and 10 degrees to make the laminar film of electrowon aluminum metal 40 run down the sloped surface of the cathode and to make the carbon dioxide bubbles 31 produced by the electrolysis of the anodes 24 and 25 flow upwards against the bottom surface of the anodes 23 and pump the molten cryolite electrolyte 32 up slope within the vertical gap between the cathodes and anodes. The molten cryolite electrolyte 32 rises up the sloped space between the cathodes and anodes because of both gas lift pumping and a buoyancy effect caused by reduced density due to electrically heating the cryolite 32. Heat is generated by electrical resistance heating of the carbon and metal parts of the cell and the molten electrolyte, and from electrochemical polarizations on the electrode surfaces. Electrical heating must balance heat lost from the cell and must provide process heat. Circulation of the molten cryolite electrolyte brings freshly dissolved alumina ore, $Al_2O_3$, into contact with the anodes and cathodes. Alumina ore is periodically introduced into the cryolite electrolyte 26 by opening the valve 17 on the storage bin 16 and by breaking the frozen cryolite crust 27 with the crust breaker bar 18. Alternatively alumina point feeders can be advantageously employed. Alumina is required to supply aluminum ions to the cell that can be electrowon to become aluminum metal and to supply oxygen ions to the cryolite required to sustain the desired anode reaction that produces carbon dioxide gas, and to avoid the undesirable so called anode effect.

Electrowon molten aluminum continuously drains into wells 42 which are built into the cathode cavity, adjacent to the drained cathode blocks 29 and 35. Most of the supersaturated concentrations of titanium and boron electrodeposited into the laminar film of molten aluminum 40 on the cathode surface deposits to form the titanium diboride coating 34 on the cathode surface and the remainder deposits in the metal wells. Because the surface area of the metal wells is by necessity only about one quarter of that of the cathode surface, the rate of growth of titanium diboride in the metal wells may be greater than on the cathode surface. To avoid excessive loss of metal reservoir capacity in the metal wells, which increases the frequency that aluminum metal must be tapped from the cell, it is undesirable to grow more than a total of one to three centimeters of titanium diboride thickness on the cathode surface.

The vertical gap between the anodes and the cathodes on the elevated and drained solid cathode surface may be reduced to between only 1 to 3 centimeters compared to 4 to 8 centimeters in a conventional aluminum reduction cell where cathodic reduction takes place on the top surface of a moving pool of liquid aluminum metal. The anodes in the improved cell may be constructed of either carbon or of an electrically conductive ceramic that is sparingly soluble in the molten salts. Oxygen ions from dissolved alumina produce carbon dioxide on carbon anodes and oxygen gas on a ceramic anode. If inert anodes are employed in the cell, it is preferable to mix titanium and boron oxides or salts with the alumina so that these elements can be fed to the cell at a uniform rate.

Titanium carbide produced by aluminum compositions that fall within zone B of FIG. 4 normally forms only a very thin aluminum wetted coating on the carbon-titanium diboride refractory materials layer. Carbon from the carbon-titanium diboride materials layer is required to react with titanium dissolved in the molten aluminum to produce this titanium carbide. Only a thin titanium carbide film will grow on the carbon-titanium diboride materials layer. Even if relatively large concentrations of titanium is dissolved in the aluminum the titanium carbide coating remains thin because the rates of diffusion of both titanium and carbon atoms through this titanium carbide coating are very slow. Titanium carbide, however dissolves relatively quickly and to a greater concentration than does titanium diboride in molten aluminum at 970° C.. Because titanium carbide grows on the cathode surface by reacting with carbon from the carbon cathode substrate, maintenance of a titanium carbide surface on the cathode typically results in the loss of 1 to 3 centimeters of carbon from the cathode carbon substrate over a five year period.

Bullough (U.S. Pat. No. 3,471,380) proposed adding sufficient bauxite, containing titanium oxides, to the cryolite bath of a conventional metal pool aluminum reduction cell to produce electrowon aluminum with a minimum titanium concentration in excess of 20,000 ppm. Bullough described his procedure as a cell start up and reconditioning treatment for carbon cathodes in conventional aluminum reduction cells with aluminum metal cathode pools. The cell operating voltage decreased by 0.5 volts for a fixed distance between the anode and an aluminum pool cathode distance. The dissolved titanium was thought by Bullough to react with the cathode carbon to produce a titanium carbide coating on the carbon lined cathode. This prior art procedure specified the operation of the cell having a conventional metal aluminum pool cathode and having very high titanium concentrations falling within zone B of FIG. 4. This practice of cell operation to produce aluminum with such large concentrations of dissolved titanium is undesirable. A limit of 50 ppm of combined vanadium and titanium is specified in many commercial alloys making aluminum produced by the art advocated by Bullough contaminated far beyond specified limits. Larger amounts of vanadium and titanium increase electrical conductivity, may interfere with casting properties, and can create excessive amounts of undesirable nonmetallic inclusions in the metal. Titanium concentrations in aluminum can, however, be reduced by treating the molten aluminum by adding elemental boron to it while it is held in furnaces after being tapped from the cells.

A thin titanium carbide layer produced by the periodic treatment advocated by Bullough would be quickly lost from a drained cathode having a carbon-titanium diboride material cathode surface and that material would be rapidly attacked. The rate of loss from an unprotected carbon-titanium diboride cathode surface can be greater than is normally experienced by carbon cathode surfaces in conventional aluminum electowinning cells. Cathode carbon substrates in conventional aluminum reduction cells may lose in excess of 1 to 10 centimeters of carbon per year.

Localized loss of a carbon-titanium diboride materials layer, and the underlying cathode block substrate of a raised cathode in a drained cathode cell, can cause harmful geometric changes to the drained cathode surface which may be detected by finding rough bottoms on anode butts when they are removed from the cell. Roughening the cathode surface interferes with draining aluminum metal and the flow of carbon dioxide and electrolyte in the vertical gap between the cathodes and anodes. Loss of an aluminum wetted cathode coating can be rapidly detected by a significant loss of current efficiency of the aluminum smelting process. The drained cathode aluminum reduction cell overheats and becomes inoperable.

The aluminum reduction cell employing the present inventive protective titanium diboride cathode coating procedures may be heated to operating temperature by any means that prevents significant burning of the carbon cathode substrate. Both gas burner and electrical heating may be used. Uniform heating of the cell may also be rapidly attained by pouring molten cryolite electrolyte and aluminum metal into the cold cell. This practice, however, may damage the carbon-titanium diboride materials layer. Aluminum reduction cells using the inventive coating procedures are best started at full line current as soon as the molten cryolite is placed in the cell. It is desirable to start a protective titanium diboride coating on the carbon-titanium diboride materials layer as soon as electrolysis is started. In order to start forming this protective titanium diboride coating, the boron concentration in the aluminum metal layer on the cathode must be greater than about 25 part per million and the titanium concentration should be greater that 200 ppm to establish zone F compositions. This procedure should establish a titanium diboride supersaturation plating rate in excess of 0.01 centimeters per year, while protecting exposed carbon in the solid part of the cathode from forming aluminum carbide. Both titanium carbide and titanium diboride will deposit. During the start-up period, the cell is advantageously operated to produce aluminum metal which contains greater titanium and boron supersaturating concentrations than desired for subsequent operation. Maintaining relatively high titanium concentrations in the electrodeposited aluminum for a few days after start-up protects the carbon-titanium diboride materials layer from being attacked by the electroreduced aluminum metal. Formation of aluminum carbide deposits in the carbon-titanium diboride materials layer is thereby prevented and titanium diboride and/or titanium carbide layers are strongly chemically bound directly onto the carbon-titanium diboride materials layer that was placed in the cell during construction.

Short term variations in the concentrations of electrowon boron and titanium in the laminar aluminum film on the cathode from time to time are not usually harmful. Occasional short duration aluminum metal composition excursions to lower boron compositions, where the composition of the aluminum falls within zones C or D, causes little harm. The average net rate of growth of the protective titanium diboride coating is merely reduced below 0.01 centimeters per year. The normal average rate of dissolution of the titanium diboride without the addition of titanium and boron ions to the cell is only about 0.04 centimeters per year. Because of local variations in the rates of titanium diboride dissolution and deposition, there may be some areas of the cathode surface where there is a small net loss of titanium diboride coating. Long term aluminum metal composition excursions to lower titanium and boron compositions, where the composition of the aluminum falls within zones A or B, may cause localized thinning and eventual loss of the protective titanium diboride coating. Repair to damaged areas of the protective titanium diboride coating may not then occur.

After the first few days following cell start up, an aluminum wetted titanium diboride coating should be well established on the cathode carbon substrate. The composition of the aluminum deposited on the cathode is modified by reducing the rate of addition of titanium and boron ions to the cryolite. The cell can then be advantageously operated to produce aluminum metal containing only sufficient titanium and boron concentrations required to form a titanium diboride coating on the solid part of the cathode surface at a rate sufficient to heal defects in the coating and to protect the carbon-titanium diboride materials layer. This procedure establishes a chemical composition of the electrowon aluminum that may be maintained throughout a several year cell life. Supersaturation plating of protective titanium diboride is advantageously carried out without interruption throughout the life of the cell to continuously repair defects in the protective coating.

If at any time during the operation of the cell aluminum chemistries fall within zones A of FIG. 4, and areas of the protective titanium diboride cathode coating are lost, as detected by rough areas on the bottom surfaces of the anode or by losses in current efficiency, it is desirable to provide a chemical treatment to produce aluminum metal having compositions that fall within zones D or F of FIG. 4. This will reestablish a continuous aluminum wetted surface on the solid part of the cathode surface on which a protective titanium diboride coating will more readily adhere. This chemical treatment requires increasing the feed rate of titanium ions to the cryolite bath to raise the concentration of titanium in the electrowon aluminum above 200 ppm. It may not be necessary to alter the boron feed rate to remove aluminum carbide deposits from the carbon surface and reestablish a continuous protective titanium diboride coating to the solid part of the cathode.

To produce a relatively thick and more protective titanium diboride coating on solid part of the cathode surface, the titanium and boron concentrations in the electrodeposited aluminum are set to compositions in zones E or F of FIG. 4. Titanium and boron codeposited into the laminar film of aluminum on the solid part of the cathode surface will form a protective coating of titanium diboride by the process of supersaturation plating at rates exceeding 0.01 centimeters per year while aluminum metal tapped from the cell may have lower titanium concentrations than is normally produced by conventional aluminum reduction cells. The ratio of boron to titanium added to the cell in zone E of FIG. 4 may be controlled to produce aluminum of greater purity than required for electrical conductors while producing a titanium diboride coating that protects the carbon-titanium diboride materials layer.

The protective coating deposited by supersaturation plating may be either titanium diboride or a mixture of titanium diboride and titanium carbide. Both titanium carbide and titanium diboride and mixtures of these materials are wetted by molten aluminum metal and are both suitable protective cathode coatings.

SPECIFIC EXAMPLES

Example 1. Titanium and boron oxides or salts are added to the cryolite electrolyte of a drained cathode aluminum reduction cell such as shown in U.S. Pat. No. 4,093,524 to electrowin aluminum with a composition of 130 ppm titanium and 60 ppm boron. This composition falls above the dashed line within zone E of FIG. 4. The aluminum metal is supersaturated with respect to titanium diboride but not with respect to titanium carbide. A protective coating of titanium diboride will deposit on the solid cathode surface at the rate of about 0.04 centimeters per year. Most of the remainder of the supersaturating concentrations of titanium and boron deposits in the metal holding wells of the aluminum reduction cell until concentrations are reduced to an equilibrium defined by the solubility product of titanium diboride. The metal tapped from the cell has a titanium concentration of about 20 ppm. Titanium carbide on the cathode surface may be transformed to titanium diboride, but aluminum carbide may also form if the carbon-titanium diboride materials layer is exposed to molten aluminum, sodium, and cryolite.

Example 2. Titanium and boron oxides or salts are added to the cryolite of a drained cathode aluminum reduction cell such as that shown in U.S. Pat. No. 4,093,524 to produce aluminum with a composition of 550 ppm titanium and 235 ppm boron. This composition falls within zone F of FIG. 4 and is also above the dashed line. Aluminum metal electrodeposited on the cathode is supersaturated with respect to titanium diboride and will react with carbon to form titanium carbide. Titanium diboride deposits on the solid cathode surface at the rate of about 0.24 centimeters per year. Because the carbon of the carbon-titanium diboride materials layer cathode substrate is covered by a non porous coating of protective titanium diboride throughout the life of the cell, little titanium carbide is formed in the protective coating. If any areas of the carbon-titanium diboride materials layer substrate become exposed due to mechanical damage or localized impingement of carbon dioxide bubbles, dissolved titanium will react with exposed carbon to deposit an aluminum wetted and protective surface film of titanium carbide. Most of the titanium and boron that does not form coatings on the cathode surface forms deposits in the metal holding well of the aluminum reduction cell so that the metal tapped from the cell contains only about 40 ppm titanium and 18 ppm boron. The rate of build up of solid deposits in the metal wells may be up to about one centimeter per year. This is nearly the maximum rate of build up of deposits that can be sustained in the metal well without excessively decreasing the volume available for the storage of aluminum metal between cell taps. Titanium dioxide and boric acid is mixed with the coke used to make the anode. 2.33 kilograms of titanium dioxide and 6.30 kilograms of ortho boric acid are mixed with each 1000 kilograms of petroleum coke and anode butts used in manufacturing the anode.

Example 3. Titanium and boron oxides or salts are added to the cryolite electrolyte of a drained cathode aluminum reduction cell such as shown in U.S. Pat. No. 4,093,524 to electrowin aluminum with a composition of 100 ppm titanium and 180 ppm boron. This composition falls above the dashed line within zone E of FIG. 4. The aluminum metal is supersaturated with respect to titanium diboride but will not react with carbon to form titanium carbide. Titanium diboride will deposit on the solid cathode surface at the rate of about 0.08 centimeters per year. Most of the remainder of the titanium and boron forms deposits in the metal holding wells of the aluminum reduction cell to an equilibrium defined by the solubility product of titanium diboride so that the metal tapped from the cell has a titanium concentration of less than 20 ppm.

Titanium dioxide and boric acid are mixed with the coke used to make the anode. 0.42 kilograms of titanium dioxide and 4.82 kilograms of ortho boric acid per 1000 kilograms of baked anode are mixed with the coal tar pitch and coke and pressed into green anodes. The anodes are calcined, rodded, and placed into the cell. The titanium and boron ions are continuously fed to the cryolite bath as the anode is burned away.

Example 4. Titanium and boron oxides are added to the cryolite electrolyte of a drained cathode aluminum reduction cell such as shown in U.S. Pat. No. 4,093,524 to electrowin aluminum with a composition of 300 ppm titanium and 10 ppm boron. This composition falls within zone D of FIG. 4 and is below the dashed line. Titanium diboride deposits on the carbon cathode substrate at an average rate of about 0.003 centimeters per year. Some areas of the cathode surface may not be continuously covered by a protective titanium diboride coating but are coated by a thin film of titanium carbide.

Example 5. Titanium and boron oxides are added to the cryolite electrolyte of a drained cathode aluminum reduction cell to produce aluminum with a composition of 300 ppm titanium and 3 ppm boron. This composition falls within zone B of FIG. 4 and is below the dashed line. The cathode surface is not covered by titanium diboride but is coated by a thin film of titanium carbide. The carbon-titanium diboride refractory layer is dissolved away at rates up to 1 centimeter per year but is continuously wetted by molten aluminum.

Titanium and boron may be fed to the carbon anodes in the form of oxides, fluorides, or carbides. As the anode is burned away, ions containing titanium will form in the cryolite. Boron and titanium oxides, carbides, salts or even titanium diboride may be mixed with the carbon and pitch used to make the carbon anodes. If at least one anode in the cell contains titanium, titanium ions will be continuously released at a uniform rate to the cryolite bath as the anode is burned off by the smelting process. If at least one anode in the cell contains boron, boron ions will be continuously fed to the cryolite. Not all anodes need to contain both titanium and boron. It is possible to feed titanium and boron at a continuous and uniform rate as long as one or more anodes contain titanium and one contains boron. Unless all the anodes contain uniform concentrations of titanium and boron, titanium diboride supersaturation plating rates may vary significantly throughout the cell.

Titanium and boron ions may also be added to the cryolite by feeding oxides, fluorides, titanates, and titanium boron glass-like materials directly through open areas of the frozen crust. These chemicals react with the cryolite to form ions containing titanium and boron. The preferred form of titanium containing chemical is titanium oxide. Unrefined titania ($TiO_2$) in the form of rutile or anatase may also be used as a source of titanium ions. If alloys that are to be made from the aluminum produced by the cell can tolerate small amounts of iron, ilmenite may be used as a source of titanium. If alloys can tolerate both iron and silicon, calcined bauxite and red mud may be used. The preferred boron containing chemicals are boron oxide ($B_2O_3$), meta boric acid ($HBO_2$) and ortho boric acid ($H_3BO_3$), however, various boron containing chemicals including boron oxide ($B_2O_3$) and sodium boron oxides such as sodium metaborate $NaBO_2$, sodium tetraborate $Na_2B_4O_2$, and borax may serve as well.

. Boron oxides including chemicals that contain boron and titanium oxides or salts may be fed continuously to the electrolyte by being premixed with the ore, may have separate addition feeders or can be hand fed. A uniform and continuous supersaturation of the electrowon aluminum metal with respect to titanium diboride in the aluminum metal may be achieved by any of the above feeding methods.

If large amounts of titanium ions are fed to the cryolite bath without also feeding boron ions, elemental titanium will be electrowon in the form of dendrites on the cathode surface. Similarly if large amounts of boron ions are fed to the cryolite bath, without also feeding titanium ions, elemental boron will be electrowon in the form of dendrites on the cathode surface. If large amounts of both titanium and boron ions are fed to the cryolite bath, titanium diboride dendrites will be electrowon on the cathode surface. Dendritic deposits may be lost from the cathode surface and will not adequately protect the carbon-titanium diboride layer. Dendritic deposits can also interfere with the smooth flow of cryolite electrolyte over the cathode surface and prevent aluminum from draining into the metal wells, thus causing electrical shorting between anode and cathodes. Titanium diboride deposited on dendrites by the process of supersaturation plating can bind them together and cement them to the surface of the carbon-titanium diboride material. In addition, a layer of supersaturation plated titanium diboride can be formed on the raised cathode surface between the dendrites to give the carbon-titanium diboride layer short duration protection from attack by aluminum, cryolite, and sodium.

Electrowinning large concentrations of titanium and boron into the aluminum metal on the drained cathode surface may result in undesirable homogeneous nucleation of titanium diboride particles within the laminar aluminum layer. These particles may cause roughening of the titanium diboride coating and can produce coatings that will not give long duration protection to the carbon-titanium diboride layer.

Alumina ores used to feed aluminum reduction cells may contain up to about 80 ppm of titanium oxide as an impurity. Over one half of the titanium from the titanium oxides or salts fed to the cell with alumina ore in conventional cells is normally lost to gasses emitted by the cell. Aluminum produced from conventional aluminum reduction cells normally contains less than 60 ppm titanium and about 2 ppm boron derived primarily from impurities in the alumina ore and impurities in the carbon anode. Aluminum metal having this composition falls in zone A of FIG. 4 and will dissolve both titanium diboride and titanium carbide and will attack carbon to form aluminum carbide.

Aluminum metal, tapped from conventional aluminum reduction cells with metal pool cathodes having carbon-titanium diboride cathode liners, installed at the time of cell construction according to prior art patents, typically has titanium and boron compositions that fall just below the solubility product line between zones A and C of FIG. 4. Aluminum metal tapped from these cells usually contains less than 200 ppm titanium and relatively less boron than the stoichiometric ratio of titanium to boron in titanium diboride. It is known that the rate of dissolution of titanium diboride from cells containing titanium diboride structures may be retarded by adding solubility suppressors in the form of from 10 to 30 ppm boron and/or from 10 to 50 ppm titanium to the aluminum in the cell (Ransley U.S. Pat. No. 3,028,324). This titanium and boron is normally added to the pool of aluminum metal in a conventional aluminum reduction cell in the form of elemental titanium and boron and borides. If these materials dissolve in the aluminum cathode pool they can provide most of the titanium and boron required to satisfy the titanium diboride solubility product so that relatively less of the very expensive titanium diboride structural elements will be dissolved by electrowon molten aluminum.

If the 2 ppm of naturally occurring boron in electrowon aluminum metal is augmented by an additional 30 ppm or more boron, according to the present invention, aluminum will be produced with compositions that fall within zone C of FIG. 4. This electrowon aluminum metal will then have a slight supersaturation of titanium diboride because of the 40 to 60 ppm of titanium in the which is derived from impurities in the alumina fed to the cryolite. A relatively low titanium diboride coating rate may be achieved by the process of supersaturation plating using this naturally occurring titanium as a source of titanium and additional boron as a source of boron. However, without feeding both titanium and boron ions to the cryolite, the rate of titanium diboride plating may be too slow to produce uniform aluminum wetted and protective surfaces on a carbon-titanium diboride materials layer. This aluminum metal does not contain sufficient dissolved titanium to react with carbon to form titanium carbide. The carbon-titanium diboride materials layer may not be protected from the uneven dissolution of the titanium diboride caused by carbon dioxide bubble scouring, from mechanical damage, and electrical shorting from anodes. Aluminum metal tapped from cells employing this chemical strategy will tend to have more boron and less titanium dissolved in it than the stoichiometric ratio for titanium diboride.

It is impractical to try to saturate aluminum metal with respect to titanium diboride by adding only titanium to the 2 ppm of naturally occurring boron impurity. Several thousand parts per million titanium is required and this would excessively contaminate the metal beyond limits permitted in most commercial alloys.

In conventional aluminum cells employing a metal pool cathode, boron oxides have been added to the cryolite for the purpose of reducing the concentrations of heavy metals in the aluminum metal tapped from the cells (Karnauklov et al, Soviet Non-Ferrous Metals Research Translation Vol. 6, No. 1, pp 16–18 1978) and U.S. Pat. No. 4,507,150 to Dube. Various group IV-B, V-D and VI-B boride particles nucleate and grow on vast quantities of tramp impurity particles in the molten aluminum pool, precipitate and accumulate as an objectionable sludge at the bottom of the cell. The average composition of the several tons of molten aluminum metal in the cathode pool never significantly exceeds the solubility product of titanium diboride and does not form a protective aluminum wetted coating on the carbon cell liner.

Sane et al in U.S. Pat. No. 4,560,448 coated ceramic packing bed elements with a very thin layer of titanium and boron oxides which were subsequently converted to an exceedingly thin coating of alumina containing about 30% by volume titanium diboride by the process of aluminothermic reduction, achieved by submerging the coated ceramic packing in molten aluminum metal. The aluminum metal pool may be either the deep cathode pool of a conventional aluminum reduction cell or an aluminum metal pool outside of an aluminum reduction cell. If this aluminotheric reaction takes place in a conventional aluminum reduction cell, the titanium and boron oxides on the ceramic packing must be prevented from dissolving in the cryolite. The ceramic packing must be more dense than both the cryolite bath and the aluminum metal in order to quickly fall through the cryolite bath and end up at the bottom of the pool of aluminum metal in the cell. The metal holding wells of a drained cathode aluminum reduction cell are too shallow and are drained too frequently to allow this aluminotheric reaction to take place. The ceramic structures would be merely dissolved by cryolite. These ceramic structures with an alumina-titanium diboride coating are intended to be dumped into cathode pools in conventional aluminum smelting cells to dampen aluminum cathode pool motion. Sane et al also dump compounds including titanium, boron, and titanium diboride into aluminum pools containing the ceramic structures in an attempt to nearly saturate the metal with respect to titanium diboride and to reduce the rate of dissolution of the titanium diboride from the coatings on the ceramic oxide packing. The procedure to attempt to reduce the rate of dissolution of titanium diboride structures submerged in deep pools of aluminum metal was originally disclosed by Ransley in U.S. Pat. No. 3,028,324.

The coatings produced by Sane et al can not function as a cathode surface in a drained cathode aluminum reduction cell because they are not sufficiently electrically conductive. They also cannot protect carbon-titanium diboride materials on a drained cathode surface of an aluminum reduction cell from being attacked by aluminum and cryolite. The alumina matrix holding the titanium diborides together would be quickly dissolved and the coating would disintegrate, allowing cryolite, sodium, and aluminum to attack the surface and penetrate into any carbon-titanium diboride material layer with resulting destruction of the non graphitic carbon of this material.

The present invention is entirely different from that of Sane et al. The present invention requires dissolution of boron and titanium oxides into the cryolite electrolyte; followed by electrochemical reduction to codeposit dissolved elements in a thin film of aluminum metal on drained cathodic surfaces in supersaturation concentrations; followed by a supersaturation plating process to form a titanium diboride layer over the carbon-titanium diboride material.

I claim:

1. A method of coating a raised cathode surface in a raised cathode type reduction cell during the production of aluminum, comprising the steps of:

feeding oxides and salts into molten cryolite electrolyte within said cell and creating concentrations of ions containing aluminum and oxygen, and ions containing a metallic element selected from the group consisting of titanium, zirconium, hafnium, chromium, vanadium, niobium, tantalum, molybdenum, tungsten, and mixtures thereof, and ions containing boron in said molten cryolite electrolyte;

electrowinning from said molten cryolite electrolyte a molten aluminum metal film against said raised cathode surface, said film containing dissolved concentrations of said metallic element and boron, which together supersaturate said aluminum metal film with the boride or mixture of borides of said metallic elements;

passing said molten aluminum metal film across said raised surface of said cathode, said raised surface comprising a refractory material wetted by molten aluminum metal; and depositing on said raised surface a boride coating created from concentrations of said metallic element or mixtures of said metallic elements and boron that exceed the saturation concentration of said boride or mixture of said borides in said molten aluminum film.

2. The method of claim 1, wherein: said metallic element comprises zirconium.

3. The method of claim 1, wherein:

said metallic element comprises titanium.

4. The method of claim 1 wherein:

said refractory material comprises a composite material containing carbon and titanium diboride.

5. The method of claim 1 wherein:

said refractory material comprises a composite material containing carbon and zirconium diboride.

6. The method of claim 1, wherein:

said coating is comprised of titanium diboride.

7. The method of claim 1, wherein:

said coating is comprised of zirconium diboride.

8. The method of claim 1, wherein:

said coating is between 5 angstroms and 5 centimeters in thickness.

9. The method of claim 1, wherein:

said coating is deposited at a rate of about 0.01 to 2.0 centimeters per year.

10. A method of maintaining an aluminum wetted coating on a drained cathode surface of an aluminum reduction cell while aluminum is being smelted from a solution of aluminum oxide dissolved in molten cryolite, comprising the steps of:

feeding oxides and salts into molten cryolite within said cell and creating concentrations of ions containing aluminum and oxygen, and ions containing a metallic element selected from the group consisting of titanium, zirconium, hafnium, chromium, vanadium, niobium, tantalum, molybdenum, tungsten, and mixtures thereof, and ions containing boron in said molten cryolite electrolyte;

electrowinning from said molten cryolite electrolyte a molten aluminum metal film against said raised cathode surface, said film containing dissolved concentrations of said metallic element or mixtures thereof and boron, which together supersaturate said aluminum metal film with the boride or mixture of borides of said metallic elements;

passing said molten aluminum metal film across said raised surface of said cathode, said raised surface comprising a substrate of refractory material, wetted by molten aluminum metal; and depositing on said raised cathode surface a boride coating created form concentrations of said metallic element or mixtures of said metallic elements and boron that exceed the saturation concentration of said borides or mixture of said borides in said molten aluminum film.

11. The method of claim 10, wherein:
said raised cathode surface is comprised of a composite material containing carbon and titanium diboride.

12. The method of claim 10, wherein:
said raised cathode surface is comprised of a composite material containing carbon and zirconium diboride.

13. The method of claim 10, wherein:
said metallic element comprises titanium.

14. The method of claim 10, wherein:
said metallic element comprises zirconium.

15. The method of claim 14, wherein:
said coating is deposited at a rate of about 0.01 to 2.0 centimeters thickness per year.

16. The method of claim 10, wherein:
is comprised of titanium diboride.

17. The method of claim 10, wherein:
said coating is comprised of titanium diboride.

18. The method of claim 10, wherein:
said coating is deposited at a rate of about 0.01 to 2.0 centimeters thickness per year.

19. A method of operating a raised cathode type aluminum reduction cell comprising the steps of:
heating said cell to operating temperature;
feeding oxides and salts into molten cryolite electrolyte within said cell and creating concentrations of ions containing aluminum and oxygen, and ions containing a metallic element, selected from the group consisting of titanium, zirconium, hafnium, chromium, vanadium, niobium, tantalum, molybdenum, tungsten, and mixtures thereof, and ions containing boron, in said molten cryolite electrolyte;
electrowinning from said molten cryolite electrolyte a molten aluminum metal film against said raised cathode surface, said film containing dissolved concentrations of said metallic element or mixtures thereof and boron, which together supersaturate said aluminum metal film with the boride or mixture of borides of said metallic elements;
passing said molten aluminum metal film across said raised cathode surface, said raised surface comprising a substrate of refractory material, wetted by molten aluminum metal; and
depositing on said raised cathode surface a boride coating created from concentrations of said metallic element or mixtures of said metallic elements and boron that exceed the saturation concentration of said borides or mixture of said borides in said molten aluminum film.

20. The method of claim 19, wherein:
said cathode substrate is comprised of a composite material containing carbon and titanium diboride.

21. The method of claim 19, wherein:
said cathode substrate is comprised of a composite material containing carbon and zirconium diboride.

22. The method of claim 19, wherein:
said metallic element is titanium.

23. The method of claim 19, wherein:
said metallic element is zirconium.

24. The method of claim 19, wherein:
said coating is comprised of titanium diboride.

25. The method of claim 19, wherein:
said coating is comprised of titanium diboride.

26. A method of operating a raised cathode type aluminum reduction cell comprising the steps of:
heating said cell to operating temperature;
feeding oxides and salts into molten cryolite electrolyte within said cell and creating concentration of ions containing aluminum and oxygen, and ions containing a metallic element, selected from the group consisting of titanium, zirconium, hafnium, chromium, vanadium, niobium, tantalum, molybdenum, tungsten, and mixtures thereof, and ions containing boron, in said molten cryolite electrolyte;
placing an anode into said molten cryolite, said anode being comprised of carbon and 0.005 to 13% by weight titanium dioxide and 0.0015 to 5% by weight boron oxide;
conducting direct electrical current through said anode into said molten cryolite producing carbon dioxide on said anode and dissolving said titanium dioxide and said boron oxide in said molten cryolite electrolyte;
electrowinning from said molten cryolite electrolyte a molten aluminum metal film against said raised cathode surface, said film containing dissolved concentrations of said metallic element or mixtures thereof and boron, which together supersaturate said molten aluminum film with the boride or mixture of borides of said metallic elements,
passing said molten aluminum metal film across said raised cathode surface, said raised cathode comprising a substrate of refractory material, wetted by molten aluminum metal; and
depositing on said raised cathode surface a boride coating created from concentrations of said metallic element or mixtures of said metallic elements and boron that exceed the saturation concentration of said boride or mixture of said borides in said molten aluminum film.

27. The method of claim 26, wherein:
said metallic element comprises zirconium.

28. The method of claim 26, wherein:
said metallic element comprises titanium.

29. The method of claim 26, wherein:
said refractory material comprises a composite material containing carbon and titanium diboride.

30. The method of claim 26, wherein:
said refractory material comprises a composite material containing carbon and zirconium diboride.

31. The method of claim 26, wherein:
said coating is comprised of titanium diboride.

32. The method of claim 26, wherein:
said coating is comprised of zirconium diboride.

33. The method of claim 26, wherein:
said coating is between 5 angstroms and 5 centimeters in thickness.

34. The method of claim 26, wherein:
said coating is deposited at a rate of about 0.01 to 2.0 centimeters thickness per year.

35. A method of operation a raised cathode type aluminum reduction cell, including a raised carbon cathode surface, comprising the steps of:
heating said cell to operating temperature;
feeding said cell with a solution of dissolved aluminum oxide, and dissolved ions containing a metallic element, selected from the group consisting of titanium, zirconium, hafnium, chromium, vanadium, niobium, tantalum, molybdenum, tungsten, and mixtures thereof, and dissolved ions containing boron, in said molten cryolite electrolyte;

electrowinning from said molten cryolite electrolyte a molten aluminum metal film against said raised cathode surface containing carbon, said film containing concentrations of said dissolved metallic element or mixtures thereof and boron, which together supersaturate said molten aluminum with the boride or mixture of borides of said metallic elements and react with carbon to form carbides of titanium, zirconium, hafnium, chromium, vanadium, niobium, tantalum, molybdenum, tungsten, and mixtures thereof;

passing said molten aluminum metal film across said raised cathode surface; and, forming on said raised cathode surface a thin film of the carbides of said metallic element or mixtures of the carbides thereof and depositing on said raised cathode surface a boride coating created from concentrations of said metallic element or mixtures of said metallic elements and boron that exceed the saturation concentration of said boride or mixture of said borides in said aluminum film.

36. The method of claim 35, wherein:

said metallic element comprises zirconium.

37. The method of claim 35, wherein:

said metallic element comprises titanium.

38. The method of claim 35, wherein:

said metallic element comprises zirconium.

39. The method of claim 35, wherein:

said coating is comprised of titanium diboride.

40. The method of claim 35, wherein:

said coating is comprised of zirconium diboride.

41. The method of claim 35, wherein:

said coating is between 5 angstroms and 5 centimeters in thickness.

42. The method of claim 35, wherein:

said coating is deposited at a rate of about 0.01 to 2.0 centimeters thickness per year.

43. A method of coating a raised cathode surface in a raise cathode type reduction cell during the production of aluminum, comprising the steps of:

feeding oxides and salts into molten cryolite electrolyte within said cell and creating concentrations of ions containing aluminum and oxygen, and ions containing a metallic element selected from the group consisting of titanium, zirconium, hafnium, chromium, vanadium, niobium, tantalum, molybdenum, tungsten, and mixtures thereof and ions containing boron in said molten cryolite electrolyte;

electrowinning from said molten cryolite electrolyte a molten aluminum metal film on said raised cathode surface, said film containing dissolved concentrations of said metallic element and boron, which together supersaturate said aluminum metal film with the boride or mixture of borides of said metallic elements;

passing said molten aluminum metal film across said raised surface of said cathode, said raised surface comprising a refractory material wetted by molten aluminum metal and having on said raised surface unconsolidated or loosely consolidated particles consisting of a boride of titanium, zirconium, hafnium, chromium, vanadium, niobium, tantalum, molybdenum, tungsten, or mixtures thereof; and, depositing on said particles on said raised surface of said cathode a boride coating created from concentrations of said metallic element or mixtures of said metallic elements and boron that exceed the saturation concentration of said boride or mixture of said borides in said molten aluminum film.

44. The method of claim 43, wherein:

said particles comprise titanium diboride.

45. The method of claim 43, wherein:

said particles comprise zirconium diboride.

46. The method of claim 43, wherein:

said coating is comprised of titanium diboride.

47. The method of claim 43, wherein:

said coating is comprised of zirconium diboride.

* * * * *